US005234886A

United States Patent [19]

Sarraf et al.

[11] Patent Number: 5,234,886

[45] Date of Patent: Aug. 10, 1993

[54] THERMAL DYE TRANSFER RECEIVER SLIDE ELEMENT

[75] Inventors: Sanwal P. Sarraf, Webster; Charles D. DeBoer; Bradley S. Jadrich, both of Rochester, all of N.Y.

[73] Assignee: Eastman Kodak Company, Rochester, N.Y.

[21] Appl. No.: 722,810

[22] Filed: Jun. 28, 1991

[51] Int. Cl.[5] ..... B41M 5/035; B41M 5/38

[52] U.S. Cl. ..... 503/227; 40/159.2; 428/13; 428/14; 428/192; 428/195; 428/412; 428/913; 428/914; 430/200; 430/945

[58] Field of Search ..... 8/471; 428/195, 13, 428/14, 913, 914, 192, 412; 40/159.2; 503/227; 430/200, 945

[56] References Cited

U.S. PATENT DOCUMENTS 4,833,124 5/1989 Lum ..... 503/227
4,873,135 10/1989 Wittnebel et al. ..... 428/192

FOREIGN PATENT DOCUMENTS 62-207691 9/1987 Japan ..... 503/227
91/19221 12/1991 World Int. Prop. O. ..... 503/227

*Primary Examiner*—B. Hamilton Hess
*Attorney, Agent, or Firm*—Andrew J. Anderson

[57] ABSTRACT

A dye-receiving element for thermal dye transfer suitable for forming a slide for projection viewing comprising a polymeric central dye image-receiving section and an integral polymeric frame section extending around the periphery of the central dye image-receiving section, the frame section being from about ½ to about 3 mm thick and the central dye image-receiving section preferably being thinner than the frame section. Such integral receiver-frames do not require post-imaging framing and mounting assembly operations in order to be viewable in slide projectors, and are particularly advantageously used in laser thermal dye transfer systems.

20 Claims, 1 Drawing Sheet

THERMAL DYE TRANSFER RECEIVER SLIDE ELEMENT

This invention relates to thermal dye transfer receiving elements, and more particularly to receiving elements which are suitable for forming a slide for projection viewing.

In recent years, thermal transfer systems have been developed to obtain prints from pictures and images which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. A line-type thermal printing head may be used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver The absorbing material may be present in a layer beneath the dye and/or it may be admixed with the dye. The laser beam is modulated by electronic signals which are representative of the shape and color of the desired image, so that each dye is heated to cause volatilization only in those areas in which its presence is required on the receiver to construct the color of the desired image. Further details of this process are found in GB 2,083,726A, the disclosure of which is hereby incorporated by reference. Additional sources of energy that may be used to thermally transfer dye from a donor to a receiver include light flash and ultrasound.

Thermal dye transfer image prints may be formed on a reflective receiver element in order to provide a color hard copy for one-to-one reflective viewing. Alternatively, thermal dye transfer images may be formed on a receiver element transparent to visible light. The resulting images are commonly viewed in the transmission mode, as in overhead projection, and such imaged elements are commonly called "overhead transparencies". Transparent thermal dye transfer receivers designed for making transparencies are generally thin, flexible films on the order of about 0.1 to 0.2 mm thick. U.S. Pat. No. 4,833,124, for example, discloses receiver elements comprising a thin dye image-receiving layer on a 0.1 mm thick transparent poly(ethylene terephthalate) film support.

Another possible way of viewing images on transparent supports is "slide" projection, commonly used to view photographic images. Slide transparency images are generally projected with enlargement (e.g. at 100 power magnification) onto a large screen. Conventional photographic slide projection transparencies commonly consist of 24 mm by 36 mm image areas cut from a continuous 35 mm wide strip of photographic film. These image areas with their perforations are conventionally mounted within an approximately 2×2 inch (about 50 mm by 50 mm) die-cut cardboard or extruded plastic two-part or folded outer frame to form a slide-mount. The two parts are either snap-assembled or heat sealed with an auxiliary heatseal border-mask. More elaborate metal or plastic frames that involve glass protection are also known. The slide-mount frames provide protection so that individual slide images may be handled and stacked without damaging the image areas, and help retain the photographic image flat and in focus during projection. Further, a wide variety of conventional commercially available slide projectors are designed to enable handling of individual framed slides from a hopper or magazine for individual and sequential viewing.

Slides offer advantages in storing and viewing transparencies such as ease of handling the images and automated sequencing of images. Slides generally have a much smaller image area than overhead transparencies, however, and with their high image magnification projection require finer detail in order to achieve a projected image of high fidelity. While conventional slide-mount frames may be used with thermal dye-transfer images formed on transparent receivers to form slides which may be viewed with conventional slide projectors, their use requires cutting and assembly operations that are awkward, time-consuming, and expensive.

It would be desirable to provide a receiver for thermal dye transfer imaging which would not require post-imaging framing and mounting assembly operations in order to be viewable in slide projectors.

These and other objects are achieved in accordance with this invention which comprises a dye-receiving element for thermal dye transfer suitable for forming a slide for projection viewing comprising a polymeric central dye image-receiving section and an integral polymeric frame section extending around the periphery of said central section, said frame section being from about ½ to about 3 mm thick.

The invention also comprises a process of forming an imaged slide element comprising (a) imagewise-heating a dye-donor element comprising a support having thereon a dye layer, and (b) transferring portions of the dye layer to a dye-receiving element suitable for forming a slide for projection viewing comprising a polymeric central dye image-receiving section and an integral polymeric frame section extending around the periphery of said central dye image-receiving section.

The invention further comprises an imaged invention.

A detailed description of the invention is given below with reference to the drawings, wherein.

An integral receiver-frame format comprising dye-image receiving section 10 and frame section 20 as shown in FIGS. 1–4 has been devised that permits thermal dye-transfer images to be made directly on an integral unit that is projectable. No separate step of mounting or assembling of the transferred image is required. The frame length L and width W dimensions (FIG. 4) are chosen so that the receiver-frame is of a size suitable for use in a slide projector. Most commercially available slide projectors are designed to accommodate conventional photographic slide frames Most conventional photographic slide frames are approximately 50 mm by 50 mm. The central dye image-receiving section length 1 and width w dimensions (FIG. 1) are selected to provide sufficient area for forming a desired image, while still maintaining a sufficient peripheral frame width such that the integral receiver-frame exhibits adequate dimensional stability and sufficient frame area so that the receiver-frame may be handled without damaging the central dye image-receiving section. Central area widths w and lengths l of from about 20 mm to about 40 mm are preferred for slides with overall lengths L and widths W of about 50 mm. For consistency with conventional photographic slides, lengths l of about 35 mm and widths w of about 23 mm are particularly preferred.

Figure 1:
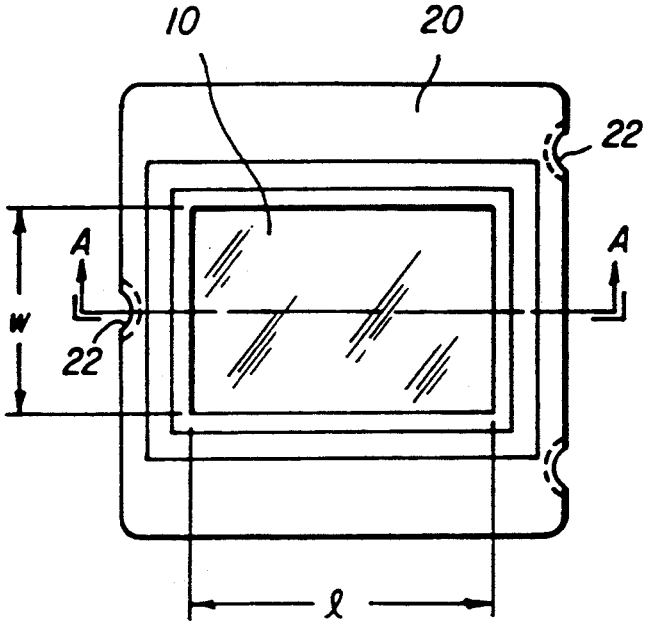
FIG. 1 is a plan view of one side of an integral receiver-frame according to the present invention.
Figure 3:
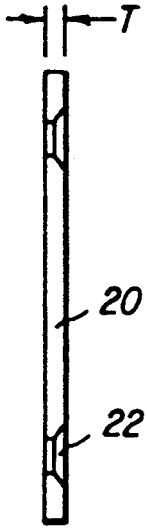
FIG. 3 is a side view of the receiver-frame illustrated in FIG. 1.
Figure 2:
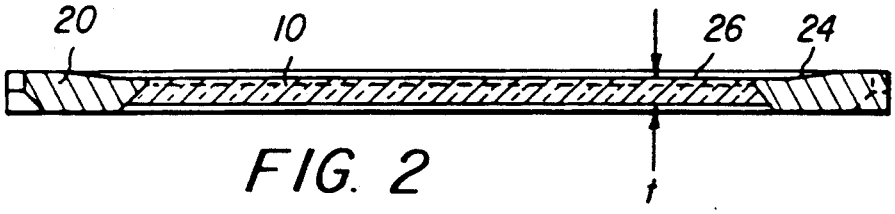
FIG. 2 is a cross-sectional view, taken along line "A"—"A" of FIG. 1, of the receiver-frame illustrated in FIG. 1.
Figure 4:
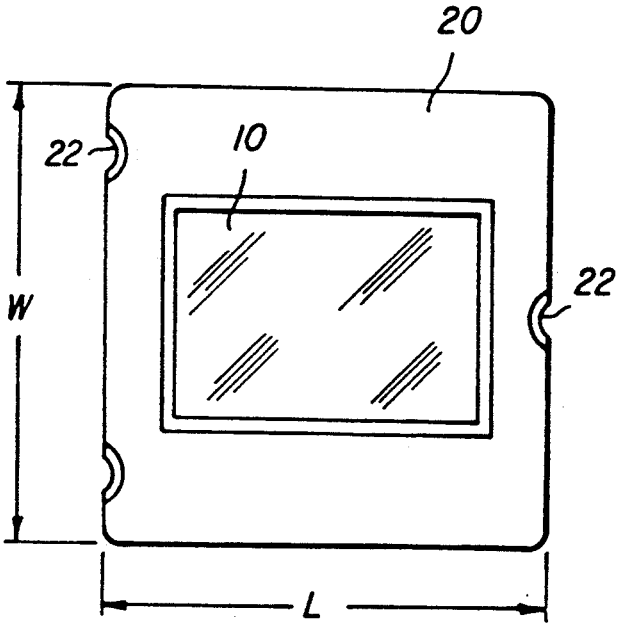
FIG. 4 is a plan view of the opposite side of the receiver-frame illustrated in FIG. 1.

The integral receiver-frame of the invention may be produced by any technique known in the "plastics art", such as injection molding, vacuum forming, or the like. The integral receiver-frame is conveniently produced from thermoplastic polymers, copolymers or mixture of polymers that are moldable or extrudable and have the capability of accepting a thermally transferable dye. The central receiver section 10 of the receiver-frame is preferably thinner than the frame section 20 to minimize scratching if the receiver-frame were slid across a flat hard surface such as a table top. The thickness difference may be embodied by the center area for imaging being recessed below the frame border as shown in FIG. 2, or the frame border may contain elevated ridges or protrusions (not illustrated). The receiver frame thickness T (FIG. 3) should be from about ½ mm to about 3 mm thick, more preferably from about 1.5 mm to about 2.5 mm thick, to have the proper thickness and weight to drop in the gate of a slide projector. Preferred thickness for the central dye image-receiving section is from about 0.2 to about 2.0 mm. These integral receiver-frames are rigid enough to stack and to stay flat and in focus during projection. Existing receiver sheets for thermal dye-transfer are too thin (0.1–0.2 mm) and flexible to be used alone for such a purpose.

Desirably, the frame section is substantially opaque (preferably having a transmission density of about 2.0 or greater) in order to minimize projected light flare. While the dye image-receiving section may be tinted to provide a uniform colored background for projected images, it is preferred that the dye image-receiving section be substantially transparent (e.g. having an optical transmission of 85% or greater) in order to maximize design flexibility for transferred images. If desired, the molding process can optionally be designed to create both an opaque border and a central transparent dye image receiving section. Logos or identification marks (not illustrated) may also be included in the border or central image area. If included in the central image area or in a transparent area of the border, such marks would be projectable. Further conventional slide features may also be incorporated into the integral receiver-frames of the invention. Indentations 22, e.g., may be molded in the edge of the border to be used as locating positions for a pin-mount projector so that multi-frame lap-dissolve techniques could be used with minimum shift of the projected image.

The polymeric material used for the outer frame and center image area may be the same, or other components may be selectively added to one part or the other. Two different polymers may be used for each of the frame or receiver providing they are compatible for molding. These concepts involving molded features, opaque areas, and logos are well known in the art as described in the book "Injection Molding of Plastics" by Islyn Thomas, Reinhold Publishing Company, New York, 1947, which is incorporated by reference.

A variety of polymers are known to be suitable as receiving layers for thermal dye transfer using such techniques as laser, thermal head, or flash lamp. Within this broad class of polymers, those that are preferred for production of an integral receiver-frame, however, are more selective. Firstly, the polymers are preferably thermoplastic and meltable for casting or extrusion at a temperature between 100° and 350° C. The following additional criteria are also important. The polymer must be cast or molded in a thickness sufficient that the receiver-frame can be loaded into a projection tray, and will drop or move into the projector without gate jamming or bending when the tray is advanced. Generally speaking, this would require a thickness of at least about one half of a millimeter. On the other hand, the thickness of the receiver-frame should not be so large that it will not fit into the common sizes of projection trays. This would be an upper limit of about 3 mm or less.

Within this range of thickness, the receiver-frame polymer should: (1) accept dye readily without significant image smearing; (2) have an optical transmission in the visible region of the spectrum of or more (i.e., not have a transmission density of greater than about (0.14); (3) have zero or minimal haze to provide for sharp-image projection; (4) have a surface scratch and dig specification of 10–5 (i.e. no scratches greater than 10 microns in width, and no digs greater than 50 microns depth.); (5) not distort more than 0.20 mm in flatness over a distance of 15 mm when warmed to its softening temperature for 60 seconds; and (6) have a surface roughness of at least 20Ra microinches as determined by ANSI B46.1.

Among various polymers, polycarbonates alone or in mixture with other polyesters and copolymers of polycarbonates and other polyesters are considered preferred. The term "polycarbonate" as used herein means a polyester of carbonic acid and a glycol and/or a dihydric phenol. Examples of such glycols or dihydric phenols are p-xylylene glycol, 2,2-bis(4-oxyphenyl) propane, bis(4-oxyphenyl)methane, 1,1-bis(4-oxyphenyl) ethane, 1,1-bis(oxyphenyl)butane, 1,1-bis(oxyphenyl) cyclohexane, 2,2-bis(oxyphenyl)butane, etc. In a particularly preferred embodiment, a bisphenol-A polycarbonate having a number average molecular weight of at least about 25,000 is used. Examples of polycarbonates include General Electric LEXAN® Polycarbonate Resin and Bayer AG MACROLON 5700®. Other polymer classes, with suitable selection, considered practical include cellulose esters, linear polyesters, styrene-acrylonitrile copolymers, styreneester copolymers, urethanes, and polyvinyl chloride. Optionally, the central dye image-receiving section may also be coated with an additional dye image-receiving layer comprising a polymer particularly effective at accepting transferred dye, such as a poly(vinyl alcohol-co-butyral).

Many polymers are not particularly preferred for forming the integral receiver-frame of the invention. For example, Magnum 9020 (a poly acrylonitrile-co-butadiene-co-styrene resin) (Dow Corning Co.) has too much absorption in the short wavelength region to be considered transparent. Polyethylene has too much haze. The phenolformaldehyles, melamine formaldehydes, ureaformaldehydes, epoxides, styrene-alkyeds, and many silicone polymers are thermosetting and thus can not be molded.

The dye-donor that is used in the process of the invention comprises a support having thereon a heat transferable dye-containing layer. The use of dyes in the dye-donor permits a wide selection of hue and color and also permits easy transfer of images one or more times to a receiver if desired. The use of dyes also allows easy modification of density to any desired level.

Any dye can be used in the dye-donor employed in the invention provided it is transferable to the dye-receiving layer by the action of the heat. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.); or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination.

The dyes of the dye-donor element employed in the invention may be used at a coverage of from about 0.05 to about 1 $g/m^2$, and are dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate; poly(styrene-co-acrylonitrile); a poly(sulfone); a poly(vinyl alcohol-co-acetal) such as poly(vinyl alcohol-co-butyral) or a poly(phenylene oxide). The binder may be used at a coverage of from about 0.1 to about 5 $g/m^2$.

The dye layer of the dye-donor element may be coated on the support or printed thereon by a printing technique such as a gravure process.

Any material can be used as the support for the dye-donor element employed in the invention provided it is dimensionally stable and can withstand the heat needed to transfer the sublimable dyes. Such materials include polyesters such as poly(ethylene terephthalate); polyamides; polycarbonates; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 250 $\mu m$. It may also be coated with a subbing layer, if desired, such as those materials described in U.S. Pat. Nos. 4,695,288 or 4,737,486.

Various methods may be used to transfer dye from the dye donor to the integral receiver-frame to form the imaged slide of the invention. There may be used, for example, a resistive head thermal printer as is well known in the thermal dye transfer art. There may also be used a high intensity light flash technique with a dye-donor containing an energy absorptive material such as carbon black or a light-absorbing dye. Such a donor may be used in conjunction with a mirror which has a pattern formed by etching with a photoresist material. This method is described more fully in U.S. Pat. No. 4,923,860, and is preferred when multiple slides having identical images are desired.

In a further preferred embodiment of the invention, the imagewise-heating is done by means of a laser using a dye-donor element comprising a support having thereon a dye layer and an absorbing material for the laser, the imagewise-heating being done in such a way as to produce a desired pattern of colorants. The use of lasers to image-wise heat dye donors to form an imaged slide is particularly desirable as lasers enable grater image resolution than other heat sources, which is particularly useful when working with the relatively small image area of a slide element.

Several different kinds of lasers could conceivably be used to effect the thermal transfer of dye from a donor sheet to the dye-receiving element to form the imaged slide of the invention, such as ion gas lasers like argon and krypton; metal vapor lasers such as copper, gold, and cadmium; solid state lasers such as ruby or YAG; or diode lasers such as gallium arsenide emitting in the infrared region from 750 to 870 nm. However, in practice, the diode lasers offer substantial advantages in terms of their small size, low cost, stability, reliability, ruggedness, and ease of modulation. In practice, before any laser can be used to heat a dye-donor element, the laser radiation must be absorbed into the dye layer and converted to heat by a molecular process known as internal conversion. Thus, the construction of a useful dye layer will depend not only on the hue, sublimability and intensity of the image dye, but also on the ability of the dye layer to absorb the radiation and convert it to heat.

Thus, in a preferred embodiment of the process of the invention, a dye image is transferred by imagewise heating a dye-donor containing an infrared-absorbing material with a diode laser to volatilize the dye, the diode laser beam being modulated by a set of signals which is representative of the shape and color of the desired image, so that the dye is heated to cause volatilization only in those areas in which its presence is required on the dye-receiver.

Lasers which can be used to transfer dye from the dye-donor element to the dye image-receiving element to form the imaged slide in a preferred embodiment of the invention are available commercially. There can be employed, for example, Laser Model SDL-2420-H2 ® from Spectrodiode Labs, or Laser Model SLD 304 V/W ® from Sony Corp. Laser thermal dye transfer imaging devices suitable for use in the process of the invention are disclosed in U.S. Pat. Nos. 5,066,962 and 5,105,206, the disclosures of which are hereby incorporated by reference.

Any material that absorbs the laser energy or high intensity light flash described above may be used as the absorbing material such as carbon black or non-volatile infrared-absorbing dyes or pigments which are well known to those skilled in the art. In a preferred embodiment of the invention, an infrared-absorbing dye is employed in the dye-donor element instead of carbon black in order to avoid desaturated colors of the imaged dyes from carbon contamination. The use of an absorbing dye also avoids problems of non-uniformity due to inadequate carbon dispersing. In a preferred embodiment, cyanine infrared absorbing dyes are employed as described in U.S. Pat. No. 4,973,572, the disclosure of which is hereby incorporated by reference. Other materials which can be employed are described in the following U.S. Pat. Nos.: 4,912,083; 4,942,141; 4,948,776; 4,948,777; 4,948,778; 4,950,639; 4,950,640; 4,952,552; 5,019,480; 5,034,303; 5,035,977; and 5,036,040.

The use of an integral receiver-frame according to the invention is particularly desirable when employing laser thermal dye transfer systems, as vaccuum hold down means are generally employed in such systems in order to achieve precise alignment of donor and receiver elements The integral receiver-frame may be formed with smooth, gradual transitions 24 (FIG. 2) from the frame surface to the dye receiving surface 26 as shown in FIG. 2 in order to insure conformation of dye donor elements to the receiver-frame and precise vaccuum hold down.

After the dyes are transferred to the receiver, the image may be treated to further diffuse the dye into the dye-receiving layer in order to stabilize the image. This may be done by thermal fusing by radiant heating or contact with heated rollers. The fusing step aids in preventing fading and surface abrasion of the image upon exposure to light and also tends to prevent crystallization of the dyes. Solvent vapor fusing may also be used instead of thermal fusing. Thermal fusing apparatus is described in copending, commonly assigned concurrently filed U.S. application Ser. No. 07/722,788, now U.S. Pat. No. 5,105,064 of Kresock entitled "Apparatus and Method for Fusing an Image onto a Receiver Element," the disclosure of which is incorporated by reference.

In the above process, multiple dye-donors may be used in combination to obtain as many colors as desired in the final image. For example, for a full-color image, four colors: cyan, magenta, yellow and black are normally used.

Spacer beads may be employed in a separate layer over the dye layer of the dye-donor in the above-described laser process in order to separate the dye-donor from the dye-receiver during dye transfer, thereby increasing its uniformity and density. That invention is more fully described in U.S. Pat. No. 4,772,582, the disclosure of which is hereby incorporated by reference. Alternatively, the spacer beads may be employed in or on the dye-receiver as described in U.S. Pat. No. 4,876,235, the disclosure of which is hereby incorporated by reference. The spacer beads may be coated with a polymeric binder if desired.

The dye-donor element employed in the invention may be used in sheet form or in a continuous roll or ribbon. If a continuous roll or ribbon is employed, it may have alternating areas of different dyes or dye mixtures, such as sublimable cyan and/or yellow and/or magenta and/or black or other dyes.

The following example is provided to further illustrate the invention.

EXAMPLE

Samples of different commercial thermoplastic resin powders or pellets were molded using an Arburg #270-90-350 in-line reciprocating screw-machine. Pertinent settings such as temperature and pressure are:

mold cooling water temperature = 60° F. (16° C.)
melt temperature, rear section = 260° F. (127° C.)
melt temperature, center section = 280° F. (138° C.)
melt temperature, front section = 280° F. (138° C.)
melt temperature, nozzle = 290° F. (143° C.)
mold pressure = 1800 lbs. (8000 Newtons)

Molded integral receiver-frames were produced as illustrated in FIGS. 1–4 having the following dimensions:

L = 50 mm
W = 50 mm
1 = 34.2 mm
w = 22.9 mm
T = 2.25 mm
t = 1.50 mm

Individual dye-donor elements were prepared by coating on a 100 μm poly(ethylene terephthalate) support:

(1) a subbing layer of poly(methyl methacrylate-covinylidene chloride-co-itaconic acid)(84:14:2 wt ratio) (0.10 g/m$^2$), (2) a second subbing layer of gelatin (0.07 g/m$^2$), (3) a dye layer containing the magenta dyes (I) and (II) (each at 0.32 g/m$^2$) and the cyanine infrared absorbing dye (III) illustrated below (0.12 g/m$^2$), DC-510 Silicone Fluid (Dow Corning Co.) (0.02 g/m$^2$) in a Morthane C-86 binder (a propietary mixture of polymers derived from 4,4'-diphenylmethaneisocyanate, 4,4'-cyclohexanedimethanol and an aliphatic dibasic acid such as adipic acid) (Morton Thiokol Co.) (0.36 g/m$^2$) coated from a butanone, cylcohexanone, and dimethylformamde solvent mixture, and (4) a spacer-layer of cross-linked poly(styrene-codivinylbenzene) beads (90:10 ratio) (15 micron average diameter), 10G surfactant (a reaction product of nonylphenol and glycidol) (Olin Corp) (0.004 g/m$^2$) in a binder of Woodlok 40-0212 white glue (a water based emulsion polymer of vinyl acetate) (National Starch Co.) (0.012 g/m$^2$).

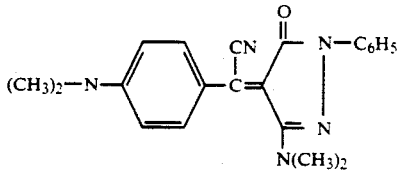

(I)

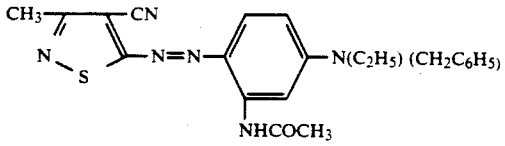

(II)

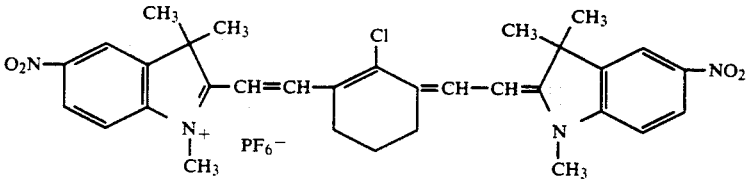

(III)

Single color magenta images were printed as described below from the dye donor sheet onto the integral receiver-frame using a laser imaging device similar to the one described in U.S. Ser. No. 457,595. The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum groves. The platen was attached to a moveable stage whose position was controlled by a lead screw which determined the y axis position of the image. The receiver-frame was held tightly to the platen and the dye-donor element was held tightly to the receiver-frame by means of vacuum grooves.

The laser beam had a wavelength of 830 nm and a power output of 37 mWatts at the platen. The measured spot size of the laser beam was an oval 7 by 9 microns (with the long dimension in the direction of the laser beam sweep). The center-to-center line distance was 12 microns (2120 lines per inch) with a laser scanning speed of 15 Hz. With this device, the imaging electronics allow any kind of image to be printed. One common test image consisted of a series of steps 5 mm by 5 mm in area of varying magenta dye densities produced by modulating the current to the laser from full power to 16% power in 4% increments.

The imaging electronics were activated and the modulated laser beam scanned the dye-donor to transfer dye to the receiver-frame. After imaging the receiver-frame was removed from the platen and the dyes were fused into the receiving polymer by heating with a 1200 watt hot-air blower. The surface of the receiver-frame was heated until the initial gold reflection color was dissipated.

The Status A Green transmission maximum density was read and recorded. The results obtained are presented in Table I below.

TABLE I

| Polymer | Print Uniformity | Status A Green Maximum Transferred Density |
|---|---|---|
| E-1 | Excellent | 1.9 |
| E-2 | Excellent | 2.7 |
| E-3 | Excellent | 2.2 |
| E-4 | Excellent | 1.9 |
| E-5 | Excellent | 1.8 |
| E-6 | Excellent | 1.6 |
| E-7 | Excellent | 1.9 |
| E-8 | Excellent | 2.6 |

Polymer Identifications
E-1 Makrolon CD-200 (Bayer AG) (a bisphenol-A polycarbonate)
E-2 Tenite Butyrate 264 (Eastman Kodak) Cellulose acetate butyrate (36% butyrl, 13% acetyl) (a cellulose ester)
E-3 Kodar PETG 6763 (Eastman Kodak) Polyethylene terephthalate (a polyester)
E-4 Tyril 1000 (Dow Chemical) Poly(styrene-co-acrylonitrile) (80:20 wt ratio)
E-5 Geon 87242 (B F Goodrich) Poly(vinylchloride)
E-6 NAS 30 (Polysar Ltd) Poly(styrene-co-methyl methacrytate) (70:30 mole ratio)
E-7 Isoplast (Dow Chemical) A proprietary polyurethane
E-8 Ektar DA003 (Eastman Kodak) A mixture of a bisphenol-A polycarbonate and poly(1,4-cyclohexylene dimethylene terephthalate) (50:50 mole ratio)

The above results demonstrate that images of high density and excellent uniformity can be obtained with the integral receiver-frames of the invention.

The invention has been described in detail with particular reference to preferred embodiments thereof, but it will be understood that variations and modifications can be affected within the spirit and scope of the invention.

What is claimed is:

1. A dye-receiving element for thermal dye transfer suitable for forming a slide for projection viewing comprising a unitary element having a substantially unimaged polymeric central dye image-receiving section and an integral polymeric frame section extending around the periphery of said central section, said frame section being from about ½ to about 3 mm thick.

2. The element of claim 1 wherein said central dye image-receiving section is thinner than said frame section.

3. The element of claim 2 wherein said central dye image-receiving section is from about 0.2 to about 2 mm thick.

4. The element of claim 3 wherein the frame section is from about 1.5 to about 2.5 mm thick.

5. The element of claim 1 wherein the central section and integral frame comprise a thermoplastic polymer.

6. The element of claim 5 wherein the central section and integral frame comprise a polycarbonate.

7. The element of claim 1 wherein said frame section is substantially opaque.

8. The element of claim 1 wherein said frame section has an optical density of about 2.0 or greater.

9. The element of claim 1 wherein said central dye image-receiving section is substantially transparent.

10. The element of claim 1 wherein said central dye image-receiving section has an optical transmission of 85% or greater.

11. The element of claim 1 wherein external dimensions of said frame section are about 50 mm by 50 mm.

12. The element of claim 11 wherein the dimensions of said central dye image-receiving section are about 23 mm by 35 mm.

13. A process of forming a thermal dye transfer imaged slide element comprising (a) imagewise-heating a dye-donor element comprising a support having thereon a dye layer, and (b) transferring portions of the dye layer to a dye-receiving element suitable for forming a slide for projection viewing comprising a unitary element having a polymeric central dye image-receiving section and an integral polymeric frame section extending around the periphery of said central dye image-receiving section, said frame section being from about ½ to about 3 mm thick.

14. The process of claim 13 wherein said central dye image-receiving section is thinner than said frame section.

15. The process of claim 13 wherein a dye image is transferred by imagewise heating a dye-donor containing an infrared-absorbing material with a diode laser to volatilize dye in the dye layer, the diode laser beam being modulated by a set of signals representative of the shape and color of a desired image.

16. The process of claim 15 wherein said infrared-absorbing material is an infrared absorbing dye.

17. The process of claim 13 wherein said frame section is substantially opaque.

18. The process of claim 13 wherein said frame section has an optical density of about 2.0 or greater.

19. An imaged slide obtained by the process of claim 13.

20. An imaged slide obtained by the process of claim 14.

* * * * *